US006425360B1

(12) United States Patent
Kashima

(10) Patent No.: US 6,425,360 B1
(45) Date of Patent: Jul. 30, 2002

(54) VALVE DRIVE MECHANISM FOR OUTBOARD MOTOR

(75) Inventor: Yukinori Kashima, Hamamatsu (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/654,199

(22) Filed: Sep. 1, 2000

(30) Foreign Application Priority Data

Sep. 2, 1999 (JP) ..... 11-249317

(51) Int. Cl.[7] ..... F01L 1/02

(52) U.S. Cl. ..... 123/90.31; 123/195 P; 123/195 C; 440/900

(58) Field of Search ..... 123/90.31, 90.17, 123/90.23, 90.27, 193.5, 195 P, 196 W, 195 C, 198 E; 440/88, 89, 900

(56) References Cited

U.S. PATENT DOCUMENTS 4,155,333 A * 5/1979 Maggiorana ..... 123/90.31
4,230,074 A 10/1980 Ichikawa et al.
4,643,143 A 2/1987 Uchiyama et al.
5,184,582 A 2/1993 Okui et al.
5,489,243 A * 2/1996 Watanabe ..... 440/900
5,564,380 A 10/1996 Kobayashi et al.
5,704,819 A 1/1998 Isogawa
5,752,866 A 5/1998 Takahashi et al.
5,755,606 A 5/1998 Takahashi et al.
5,765,519 A 6/1998 Watanabe
5,848,578 A 12/1998 Uchiyama et al.
5,865,655 A 2/1999 Hiraoka et al.
5,873,755 A 2/1999 Takahashi et al.
5,911,608 A * 6/1999 Nakayama et al. ..... 440/89
5,957,099 A * 9/1999 Kobayashi et al. ..... 123/90.31
6,032,628 A * 3/2000 Watanabe et al. ..... 123/90.31
6,044,817 A * 4/2000 Hiraoka et al. ..... 123/90.31
6,053,155 A * 4/2000 Kashima ..... 123/196 W
6,053,785 A * 4/2000 Kato et al. ..... 123/195 P
6,250,982 B1 * 6/2001 Kashima ..... 440/900
6,264,515 B1 * 7/2001 Mineno et al. ..... 440/88

* cited by examiner

*Primary Examiner*—Teresa Walberg
*Assistant Examiner*—Fadi H. Dahbour
(74) *Attorney, Agent, or Firm*—Knobbe, Martens Olson & Bear, LLP

(57) ABSTRACT

An engine has a valve drive arrangement that uses dead space within an outboard motor cowling. The engine has a first set of cylinders and a second set of cylinders. The first set of cylinders is offset from the second set of cylinders such that one is arranged closer to a first end of the engine that the other. The higher set of cylinders includes a set of cam shafts that are coupled at the end closer to the first end of the engine while the lower set of cylinders includes a set of cam shafts that are coupled at the end farther from the first end of the engine. A drive arrangement connects the two sets of cam shafts to the crankshaft.

15 Claims, 8 Drawing Sheets

VALVE DRIVE MECHANISM FOR OUTBOARD MOTOR

RELATED APPLICATIONS

This application is based on Japanese Patent Application No. 11-249317, filed Sep. 2, 1999, the entire contents of which is hereby expressly incorporated by reference.

BACKGROUND OF THE INVENTION

1. Field of the Invention

The present invention generally relates to valve driving arrangements for outboard motors. More specifically, the present invention relates to an improved compact arrangement of valve driving components.

2. Related Art

Outboard motors are used to power watercraft to the water. The outboard motors are mounted to the transom or rear portion of the watercraft and provide a forward or reverse thrust. Because the outboard motor extends upward above a portion of the watercraft, the outboard is exposed to passing air streams caused by the movement through the water. Accordingly, the outboard motor can be a source of wind resistance or drag during movement through the water. This wind resistance results in decreased watercraft speeds or increased loading on the outboard motor.

Accordingly, it is desired to decrease the size of the exposed portion of the outboard motor. In some configurations, the outboard motors is decreased in a lateral direction while in other arrangements the engine is decreased in a vertical direction. By designing a more compact engine, the overall dimensions of the outer cowling, which surrounds the engine, can be decreased.

With reference now to FIG. 1, a typical outboard motor 10 is illustrated therein. In an effort to decrease the lateral dimension of the outboard motor 10, a pair of cylinder banks 11 have been designed with cylinders 12 that are offset from one cylinder bank to the other. In particular, the engine generally comprises a V-type configuration having a first bank of cylinders 12 and a second bank of cylinders 12. The first bank of cylinders comprises a plurality of cylinders 12 having a corresponding plurality of central axes A that extend through the cylinder bores while the second bank of cylinders is similarly comprised. As will be appreciated, one bank of cylinders is offset by approximately half of the diameter of cylinder bores in the other bank. Such a configuration allows the cylinder and the lateral dimension of the cylinder block to be decreased. This configuration, however, has ordinarily resulted in an increased height to the outboard motor due to an increased vertical dimension required to accommodate a cam shaft drive arrangement 14.

The cam shaft drive arrangement 14 typically uses rotational motion from the crankshaft to drive the intake cam shaft 15 and the exhaust cam shaft 16. The intake cam shaft 15 powers the intake valves while the exhaust cam shaft 16 powers the exhaust valves. Generally, as shown in FIG. 1, power is taken from the crankshaft into one of the intake cam shafts 15 or one of the exhaust cam shafts 16. The power taken from the crankshaft into one of the cam shafts 15, 16 is then transferred to the other of the paired cam shafts 15, 16. For instance, in the illustrated arrangement, power is taken from the crankshaft and transferred to the intake cam shaft 15 of the left cylinder bank and the exhaust cam shaft 16 of the right cylinder bank. The rotational motion then is transferred from the exhaust cam shaft 16 of the right cylinder bank to the intake cam shaft 15 of the right cylinder bank through a drive pulley 17 and a driven pulley 18 that are connected with a flexible transmitter 19, such as a belt. Similarly, power is transferred from the exhaust cam shaft 16 of the left cylinder bank to the intake cam shaft 15 of the left cylinder bank through a drive pulley 17 and a driven pulley 18 that are connected with a flexible transmitter 19.

This arrangement, however, results in the undesirable increase in the vertical dimension of the engine. As illustrated in FIG. 1, the length of the cam shafts 15, 16 in the left cylinder bank must be increased to place the input pulley 13 at an appropriate location relative to the input pulley 13 of the cam shafts 15, 16 of the right cylinder bank. Elongating the cam shafts results in the undesirable increase in the vertical dimension of the outboard motor. In addition, increasing the length of the cam shafts 15, 16 increases the weight of the engine due to the excess material of the cam shaft extension. Furthermore, the strength of the elongated cam shafts must be increased to withstand the loading on the increased length of the cam shaft.

SUMMARY OF THE INVENTION

Accordingly, a more compact cam shaft drive arrangement is desired. Such an arrangement desirably should decrease the overall length of at least one set of cam shafts. The cam shaft drive arrangement preferably takes advantage of an offset cylinder configuration.

One aspect of the present invention involves an engine for use in an outboard motor. The engine comprises a pair of cylinder banks. A first set of cylinder bores is disposed in a first cylinder bank of the pair of cylinder banks. A second set of cylinder bores is disposed in a second cylinder bank of the pair of cylinder banks. A first plane is defined through central axes of the first set of cylinder bores and a second plane is defined through central axes of the second set of cylinder bores. The first plane and the second plane intersect at an angle. The engine has a first end surface. A crankshaft has a power take off end that extends through the first end surface. The first set of cylinder bores has a first end cylinder bore and the second set of cylinder bores has a second end cylinder bore. The first end cylinder bore is positioned closer to the first end surface than the second end cylinder bore. A first intake cam shaft and a first exhaust cam shaft are associated with the first cylinder bank and a second intake cam shaft and a second exhaust cam shaft are associated with the second cylinder bank. Power from the crankshaft drives the first intake cam shaft, the first exhaust cam shaft, the second intake cam shaft and the second exhaust cam shaft. The first intake cam shaft and the first exhaust cam shaft are joined by a first drive connection and the second intake cam shaft and the second exhaust cam shaft are joined by a second drive connection. The second drive connection is positioned at an end of the second intake cam shaft and the second exhaust cam shaft that is closest to the first end surface and the first drive connection is positioned at an end of the first intake cam shaft and the first exhaust cam shaft that is farthest from the first end surface.

Another aspect of the present invention involves an engine comprising a crankshaft and a cylinder block that comprises a first cylinder bank and a second cylinder bank. The cylinder block has a first end and an opposing second end. The crankshaft has a power take off end that extends through the first end of the cylinder block. The engine comprises a first set of cam shafts that are associated with the first cylinder bank and a second set of cam shafts that are associated with the second cylinder bank. The first set of cam shafts are coupled for rotation proximate the first end of the cylinder block and the second set of cam shafts are coupled for rotation proximate the second end of the cylinder block.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENTS OF THE INVENTION

Figure 1:
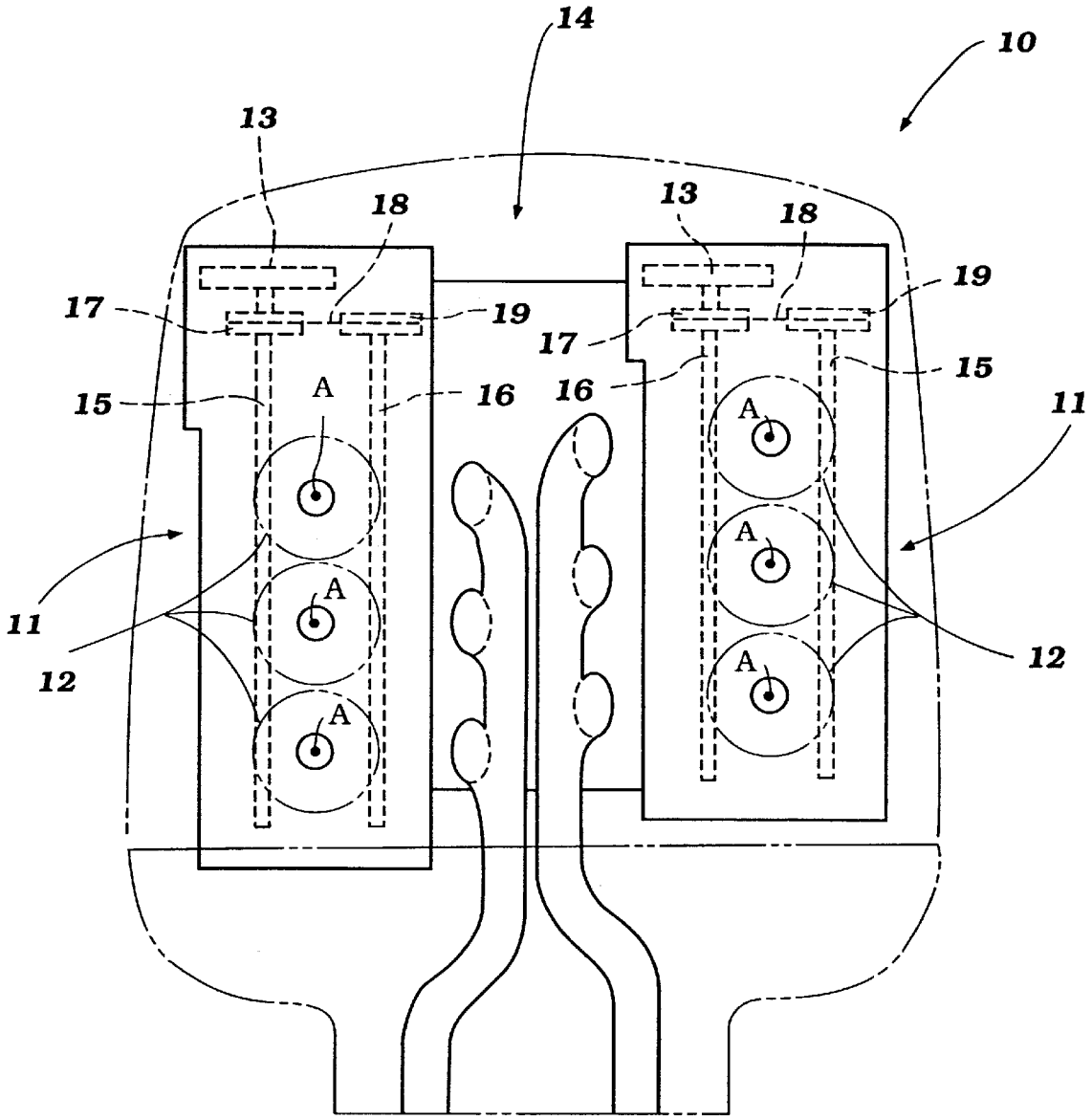
Figure 1 Prior Art
FIG. 1 is a simplified rear view of a prior art outboard motor illustrating an engine in solid and a cowling in phantom. The engine features an offset cylinder arrangement and illustrates in hidden line a cam shaft drive arrangement typical of such engines.
Figure 2:
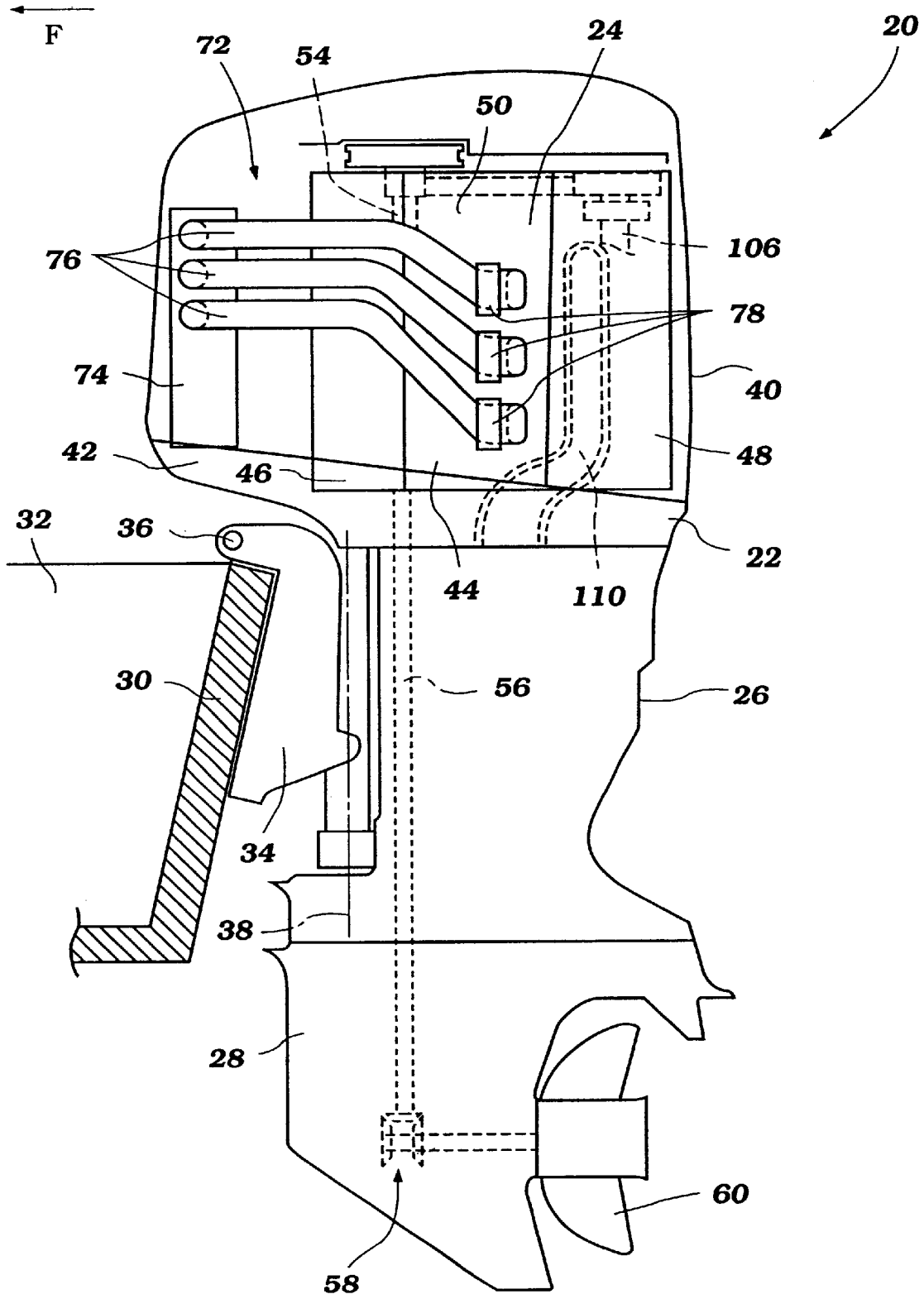
FIG. 2 is a side elevational view of an outboard motor attached to a transom of a watercraft the engine having a cam shaft drive arrangement having certain features, aspects and advantages of the present invention.

With reference now to FIG. 2, an outboard motor is illustrated therein. The outboard motor is generally indicated by the reference numeral 20. The outboard motor desirably has a cam drive arrangement arranged and configured in accordance with certain features, aspects and advantages of the present invention. While the present invention will be described in the context of the outboard motor 20, it will be readily recognized by those of ordinary skill in the art that the present invention may also find utility in other engine applications. For instance, in applications where the engine size desirably is reduced, the present invention may find particular utility.

The outboard motor 20 generally comprises a protective cowling 22 that encases an internal combustion engine 24. The outboard motor 20 also comprises a driveshaft housing 26 and a lower unit 28. The protective cowling 22, the driveshaft housing 26 and the lower unit 28 combine to form an outer casing for the outboard motor 20. This outer casing is mounted to a transom 30 of a watercraft 32 powered by the outboard motor 20.

In the illustrated arrangement, the outboard motor 20 is connected to the transom 30 using a mounting bracket 34. The mounting bracket 34 generally comprises a generally horizontally disposed pivoting axis 36 that allows the outboard motor 20 to be tilted and trimmed relative to the watercraft 32. In addition, the mounting bracket 34 comprises a generally vertically extending axis 38 about which the outboard motor 20 may be steered relative to the watercraft 32. Any suitable mounting bracket 34 may be used to mount the outboard motor 20 to the watercraft 32.

With continued reference to FIG. 2, the upper cowling 22 preferably comprises an upper portion 40 and a lower portion 42. The upper portion 40 and the lower portion 42 preferably are removably attached to each other. In one arrangement, the two components 40, 42 may be pivotably connected to one another. In addition, the connection between the upper portion 40 and the lower portion 42 desirably is substantially watertight to reduce the likelihood of infiltration of water or other liquids into the engine compartment defined within the protective cowling 22.

Figure 3:
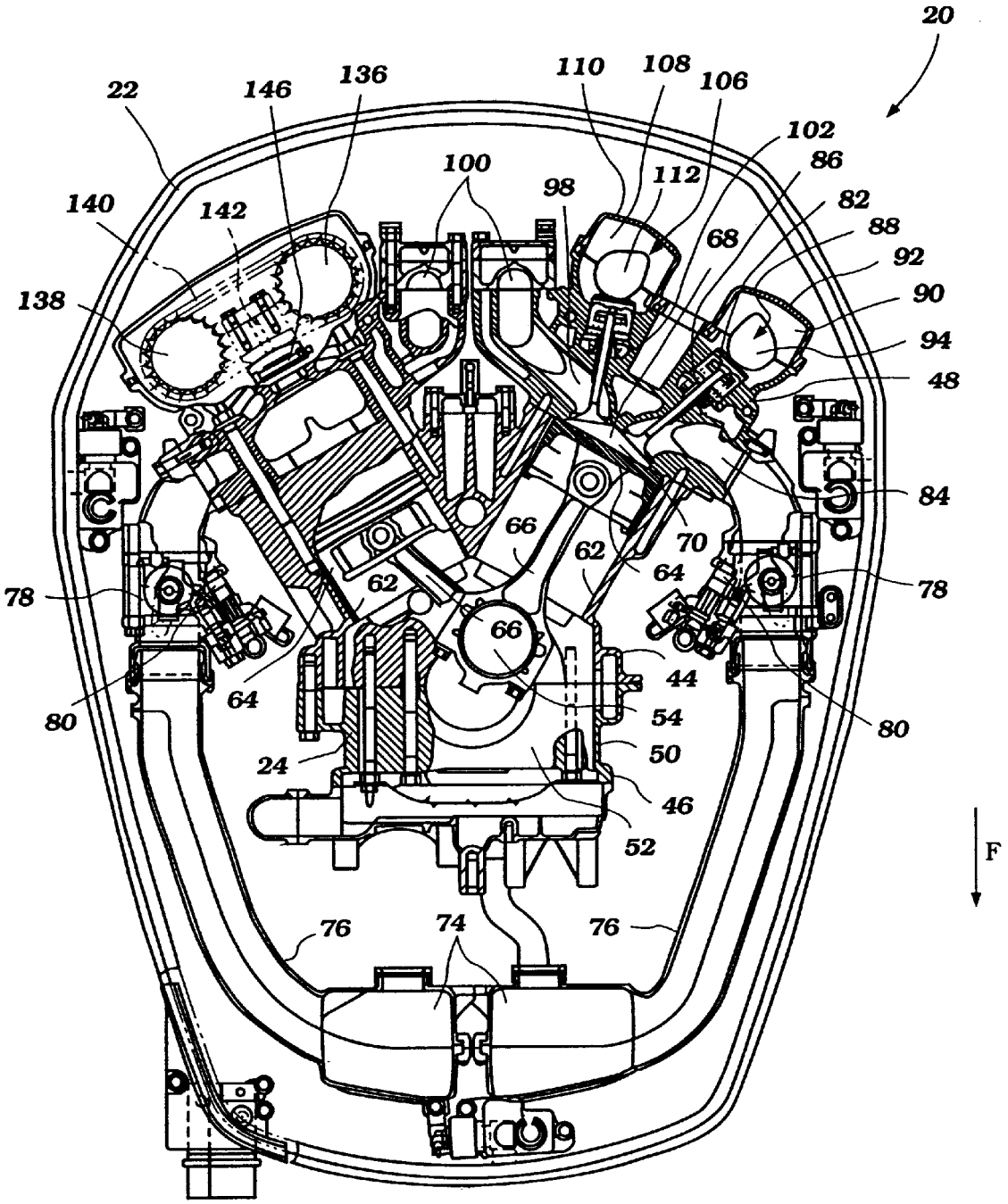
FIG. 3 is a top plan view of the outboard motor of FIG. 2 with the upper cowling removed and a portion of the engine illustrated in section.

With reference now to FIGS. 2 and 3, the engine 24 of the outboard motor 20 will be described in more detail. Generally speaking, the engine 24 comprises a cylinder block 44, a crankcase cover 46 and a cylinder head 48. As is generally known, the cylinder block and the crankcase member 44, 46 are combined to form an engine case 50. These components can be attached in any suitable manner and together form a crankcase chamber 52. A crankshaft 54 is journaled for rotation within the crankcase chamber 52. The crankshaft 54 is connected at one end to a driveshaft 56 in any suitable manner.

The driveshaft 56 extends downward through the driveshaft housing 26 and terminates proximate a forward/neutral/reverse-type transmission 58. Of course, other suitable transmissions also may be used. The driveshaft 56 powers a propulsion unit 60 through the right angle transmission 58 in the illustrated arrangement. In the illustrated arrangement, the propulsion device 60 preferably is a propeller. In some arrangements, however, the propulsion device 60 may comprise a jet pump or any other suitable propulsion unit for an outboard motor or marine drive. In other applications, the driveshaft 56 may power other suitable propulsion devices 60 such as wheels, tracks or the like.

With reference now to FIG. 3, the cylinder head 48 is connected to the cylinder block 44. The cylinder block 44 may be formed within a single block of material or may comprise a number of individual cylinder bodies that are arranged side-by-side or in any other suitable configuration. It should be noted that while the present engine 24 comprises a V6 engine that operates on the four cycle operating principle, the engine may have any number of cylinders and may be arranged in any suitable configuration while operating on any suitable operating principle and still make use of a cam drive arrangement having certain features, aspects and advantages in accordance with the present invention.

The cylinder block 44 preferably comprises a number of cylinder bores 62. A set of pistons 64 are arranged for reciprocation within the cylinder bore 62 in manners well known to those of skill in the art. The pistons 64 are connected to the crankshaft 54 using connecting rods 66. It should be noted that the crankshaft 54 has a power take off end and a flywheel end. Of course, the power take off end is the end connected to the drive shaft 56 and the flywheel end is the opposite end in the illustrated arrangement. Accordingly, the cylinder of each cylinder bank that is the closest to the power take off end can be called the power take off cylinder and the cylinder of each cylinder bank that is closest to the flywheel end can be called the flywheel cylinder. This arrangement is also well known to those of ordinary skill in the art.

The cylinder heads 48 preferably comprise a number of recesses 68 that are formed in alignment with the cylinder bores 62. The recesses 68, in combination with the cylinder bore 62 and the head of the piston 64, form combustion chambers 70. The combustion chambers 70 are variable volume combustion chambers such as those well known to those of ordinary skill in the art. Variable volume means the volume within the combustion chamber 70 changes with the reciprocation of the piston 64 within the cylinder bore 62. For instance, as the piston 64 descends within the cylinder bore 62, the volume of the combustion chamber increases. Similarly, as the piston 64 rises within the cylinder bore 62 and approaches the cylinder head 48, the volume within the combustion chamber 70 decreases and the pressure rises.

The engine 24 also comprises an induction system 72. The induction system 72 can be formed in any suitable manner. In the illustrated arrangement, the induction system 72 comprises an air silencer 74. More particularly, in the illustrated arrangement, the engine 24 features a pair of air silencers 74 that are used to supply a fresh air charge from within the engine cowling 22 to each side of the engine 24 independently. Air is drawn into the cowling 22 through an air inlet opening (not shown). The air is then inducted into the air silencer 74 through a vacuum caused by the operation of the engine 24. Once inducted into the air silencer 74, the air travels through an air intake pipe 76 that is associated with each cylinder bank. In other words, the right cylinder bank has its own intake pipe 76 and air silencer 74 while the left cylinder bank also has its own intake pipe 76 and air silencer 74. The air ingested into the air silencer 74 thus flows through the intake pipe 76 towards the combustion chambers 70. Between the combustion chambers 70 and the air silencer 74, a number of throttle bodies are disposed along each intake pipe 76. It should be noted that in the illustrated arrangement, three intake pipes 76 travel to three respective combustion chambers 70 and feature three corresponding throttle bodies 78. Of course, other arrangements also are possible.

As is generally known, the throttle body 78 comprises a throttle shaft and a throttle valve. The throttle valve rotates about the throttle shaft and controls the flow rate through the intake pipe 76 in accordance with the operator demand. The illustrated arrangement also features indirect injection. While the present invention is being illustrated with an engine featuring indirect injection, it should be recognized that the present invention may also be used with a directly injected engine and a carbuerated engine. In the illustrated arrangement, a set of fuel injectors 80 are disposed for injection into the induction system 72 at a point outside of the cylinder head 48. In particular, each fuel injector 80 is disposed proximate an associated throttle body 78 and preferably is mounted to the throttle body 78 in any suitable manner.

Flow of the air fuel charge from the throttle body 78 into the combustion chambers 70 preferably is controlled by an intake valve 82. In the illustrated arrangement, a single intake valve is associated with each of the combustion chambers 70. It should be recognized, however, that certain features, aspects and advantages of the present invention may also be used in induction systems featuring more than one intake valve 82 per combustion chamber 70.

In the illustrated arrangement, the air fuel charge passes through an intake passage 84 under the control of the intake valve 82. The intake passage 84 is formed within the cylinder head 48 in any suitable manner.

The intake valve 82 preferably is biased by a spring 86 into a closed position. An intake cam shaft 88 is journaled for rotation within a cam chamber 90 in manner which will be described. The cam chamber 90 is formed by a cam cover 92 that forms a portion of the cylinder head 48.

The cam shaft 88 comprises a number of cam lobes 94. The cam lobes 94 have a suitable profile for driving the intake valves 82 to an open position at a particular timing to control the inflow of an air fuel charge into the combustion chamber 70. Typically, the cam lobe 94 depresses the intake valve 82 against the biasing force of the spring 86 to open the intake valve 82 from the seat formed in the cylinder head 48. The removal of the valve 82 from the seat allows the air fuel charge to flow into the combustion chamber 77, typically on a downstroke of the piston 64 within the cylinder bore 62. The exact timing of this intake process can vary.

The air fuel charge then is compressed within the combustion chamber 70 and is ignited by an ignition system (i.e., a spark from a sparkplug (not shown)). The sparkplug, however, typically is mounted within the cylinder head through a mounting bore 96 (see FIG. 5). After ignition, the air fuel charge is converted into exhaust gases. The exhaust gases desirably are removed from the combustion chamber 70 through a suitable exhaust system.

Figure 5:
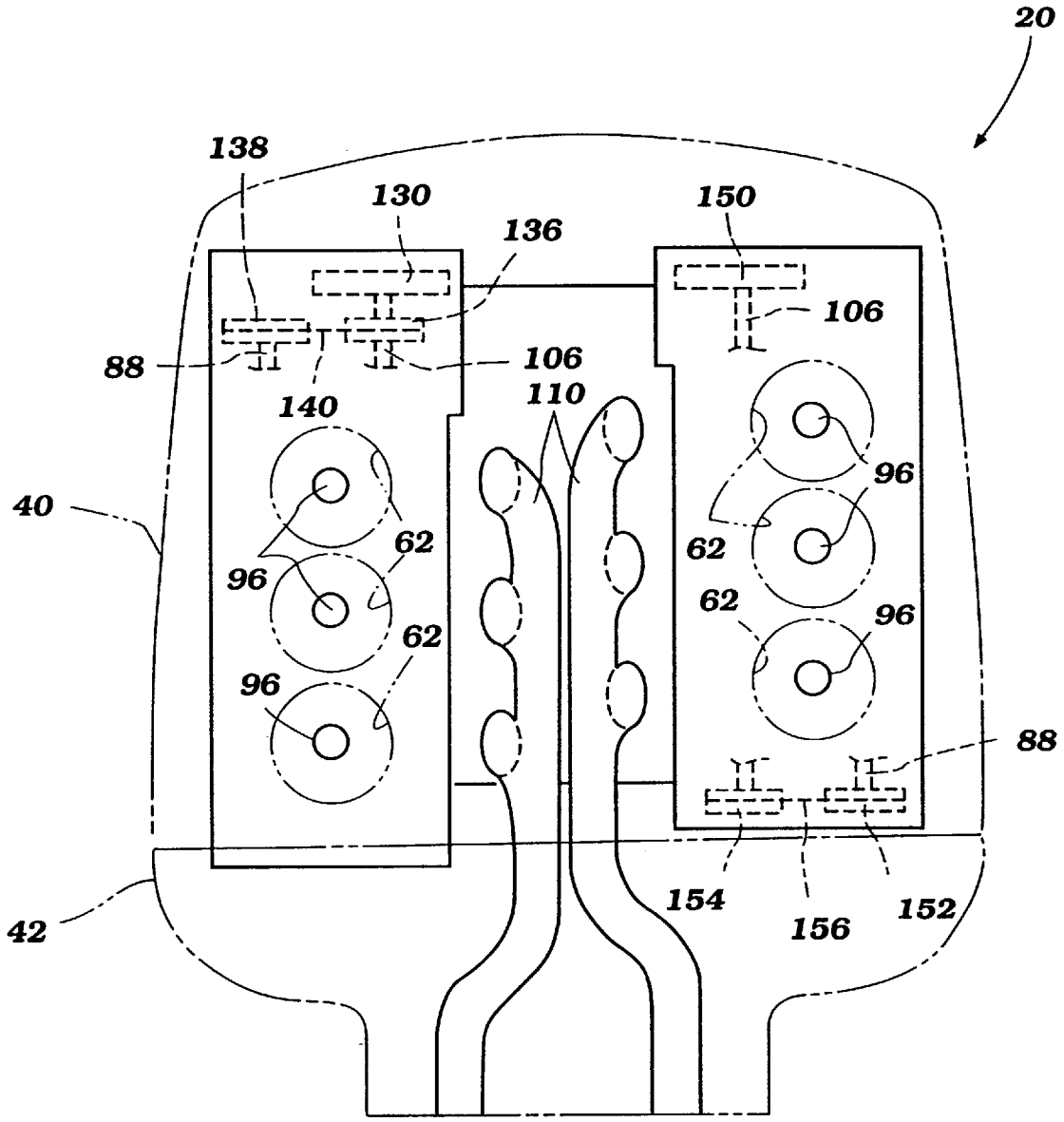
FIG. 5 is a rear elevation view of an outboard motor having an engine with a cam shaft drive arrangement arranged and configured in accordance with certain features, aspects and advantages of the present invention.

With reference now to FIGS. 2, 3 and 5, the exhaust gases preferably are removed from the combustion chamber via the exhaust system. The exhaust system in the illustrated arrangement comprises an exhaust passage formed within the cylinder head 48. The exhaust passage is indicated by the reference numeral 98. As will be understood, each cylinder comprises at least one, if not more than one, exhaust passage extending from the cylinder head toward an exhaust manifold 100. Flow through the exhaust passage 98 from the combustion chamber 70 desirably is controlled by an exhaust valve 102. The exhaust valve 102, similar to the intake valve 82, includes a spring 104 that biases the exhaust valve 102 into a closed position in the illustrated arrangement. An exhaust cam shaft 106 preferably is disposed within an exhaust cam chamber 108 that is formed by the cylinder head 48 and the cam cover 110.

Similar to the intake cam shaft 88, the exhaust cam shaft 106 comprises a number of cam lobes 112. The cam lobes are sized and configured to displace the exhaust valve 102 and allow exhaust gases to pass into the exhaust passage 98.

With reference now to FIG. 5, the exhaust gases pass from the exhaust passage 98 into the exhaust manifold 110 through a plurality of runners. The exhaust manifold 110 further cooperates with passages formed within the driveshaft housing 26 and other components. In some applications, the exhaust manifold 100 extends downward to a passage formed within an exhaust gas guide plate upon which the engine is mounted. The exhaust gas is then passed downward into an expansion chamber and then out a through-the-hub underwater discharge or an above-the-water low speed discharge. Because these arrangements are well known to those of skill in the art, further description is not necessary.

The intake valves 82 and the exhaust valves 102 are driven by the intake cam shaft 88 and the exhaust cam shaft 106. A driving arrangement for these shafts 88, 106 will now be described with reference to FIGS. 2–7. The driving arrangement features various aspects of the present invention. It will be noted that the driving arrangement in the illustrated outboard motor 20 takes advantage of the particular configuration of the outboard motor 20. It is anticipated that this configuration may also be used in other applications besides outboard motors. However, it has been found that the driver arrangement has particular utility with this outboard motor.

Figure 4:
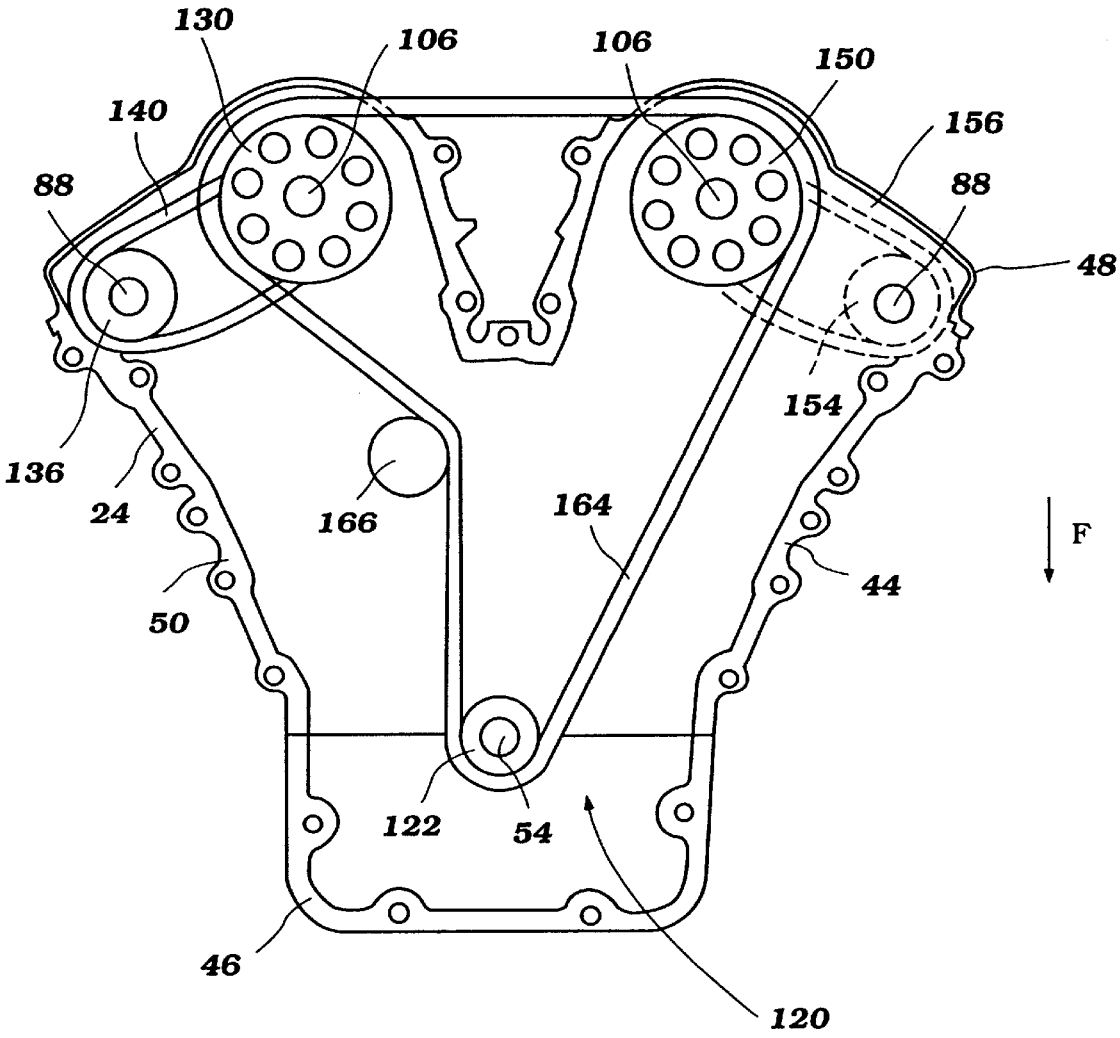
FIG. 4 is a simplified top plan view of a cam shaft drive arrangement having certain features, aspects and advantages in accordance with the present invention.
Figure 8:
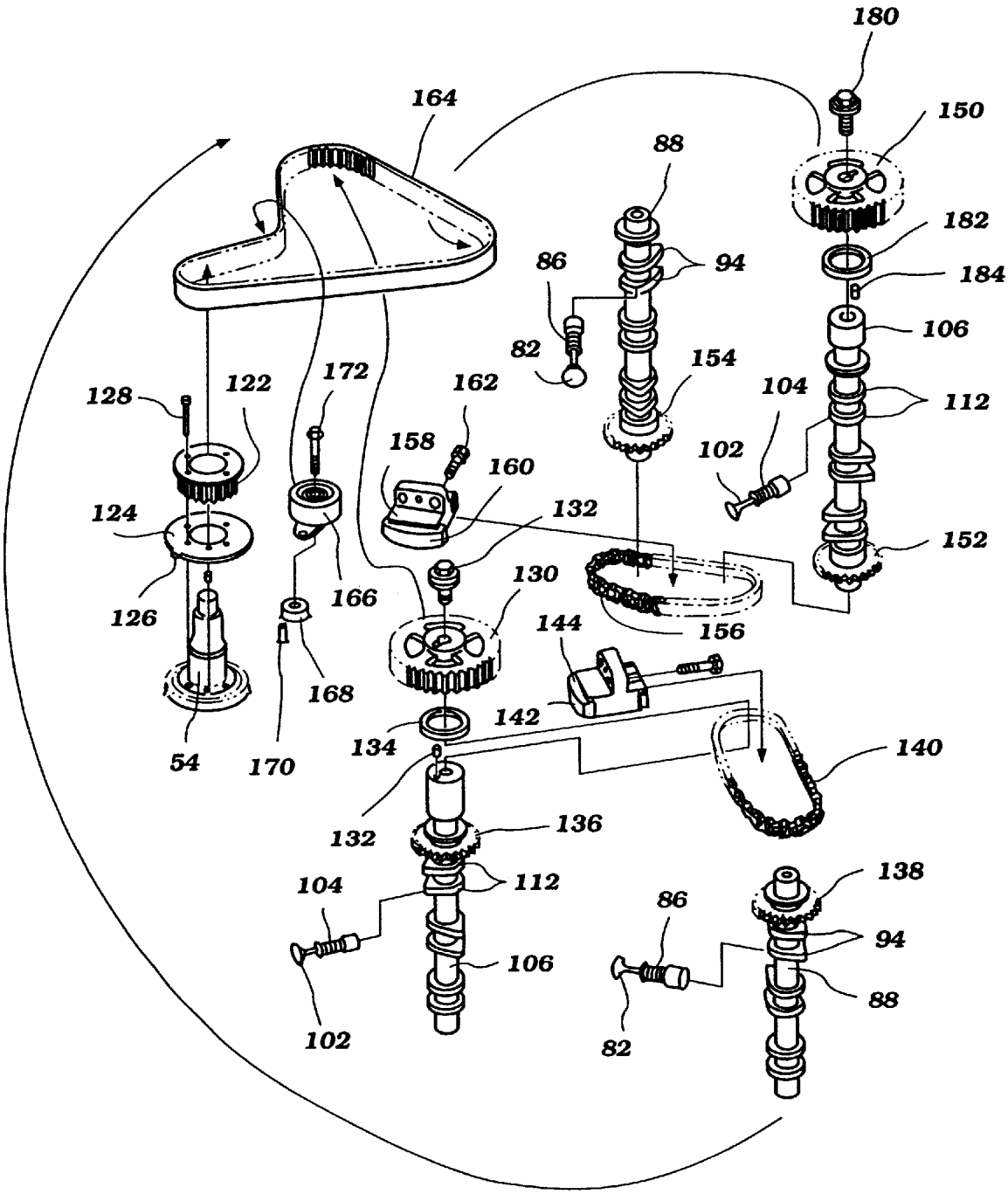
FIG. 8 is an exploded perspective view of the main components of the cam drive arrangement illustrated in FIGS. 2–7.

With reference now to FIG. 4, a simplified top view of the drive arrangement 120 is illustrated therein. As illustrated, a portion of the crankshaft 54 is used to carry a drive pulley 122. With reference to FIG. 8, an upper portion of the crankshaft 54 has a stepped portion that receives a position detecting washer 124 and the drive pulley 122. The position detecting washer 124 preferably contains a position indicating tab 126 or another suitable position identifying mechanism that cooperates with a sensing or sending unit to allow the engine's CPU or controller to identify the relative positioning of the crankshaft within its 720° cycle. Moreover, in the illustrated arrangement, both the drive pulley 122 and the position detecting washer 124 contain a plurality of holes that receive bolts 128. The bolts 128 or other threaded fasteners secure the drive pulley 122 and the position detecting washer 124 to the crankshaft 54. In this manner, both the washer and the pulley 124, 122 rotate with the crankshaft 54.

With reference again to FIG. 4, the right cylinder bank in the illustrated arrangement contains a driven exhaust cam shaft 106. The exhaust cam shaft 106 is driven by a driven pulley 130. With reference again to FIG. 8, a threaded fastener 132 attaches the driven pulley 130 to the cam shaft 106. As described above, the cam shaft 106 contains a number of cam lobes 112 that are used to actuate the exhaust valves 102. An end of the cam shaft 106 includes an aperture that receives a positioning pin 132. The positioning pin orients the driven pulley 130 in a desired orientation as well as reduces the likelihood of relative spinning between the driven pulley 130 and the cam shaft 106. In addition, a seal 134 is disposed between the driven pulley 130 and the cam shaft 106.

The cam shaft 106 also includes a coupling sprocket 136. The coupling sprocket 136 drives the intake cam shaft 88. Specifically, in the illustrated arrangement, the intake cam shaft 88 includes a second coupling sprocket 138 that is connected to the first coupling sprocket 136 with a chain 140. While in the illustrated arrangement, a chain drive is used, other driving arrangements also can be used, such as gear trains and belt drives. The chain drive, however, advantageously maintains the 1:1 ratio between the two cam shafts 88, 106. In the illustrated arrangement, the chain 140 is tensioned with a guide 142. The guide 142 includes a slide plate 144 over which the chain 140 slips. With the guide 142, the chain can be tensioned such that the likelihood of the chain 140 disengaging from either of the sprockets 136, 138 is reduced. With reference to FIG. 3, the guide 142 is secured to a mounting boss 146 formed in the cylinder head. Of course, other mounting arrangements also can be used depending upon the application.

With reference again to FIGS. 4 and 5, the other cylinder bank also includes a drive arrangement that is similar to that of the first cylinder bank in some respects. More particularly, in this arrangement, the exhaust cam shaft 106 is driven with a drive pulley 150. In this arrangement, however, the driven pulley 150 is positioned at one end of the exhaust cam shaft 106 while a driven sprocket 152 is disposed at the opposite end of the cam shaft. The first sprocket 152 drives a second sprocket 154 which is disposed at the lower end of the intake cam shaft 88. The first and second sprockets 152, 154 are connected together by a chain 156 which can also be biased by a guide plate 158. A guide plate may comprise a wear plate 160 and preferably is attached to a mounting boss with a threaded fastener 162.

With reference again to FIG. 4, a belt 164 preferably connects the drive pulley 122 to the driven pulleys 130, 150. The belt 164 can be tensioned through a tensioning roller 166. With reference again to FIG. 8, the tensioning roller 166 preferably is connected to a mounting boss 168 and a location pin 170. In the illustrated arrangement, a threaded fastener 172 is used to connect the idler roller 166 to the engine block. Of course, other suitable mounting arrangements can also be used.

With reference still to FIG. 8, preferably the driven pulley 150 is secured to an upper end of the exhaust cam shaft 106 using a threaded fastener 180. A seal 182 desirably is interposed between the driven pulley 150 and the cam shaft 106. In addition, a positioning pin 184 is used to position the pulley 150 in an appropriate orientation and to maintain the orientation of the pulley 150 relative to the cam shaft 106.

Figure 6:
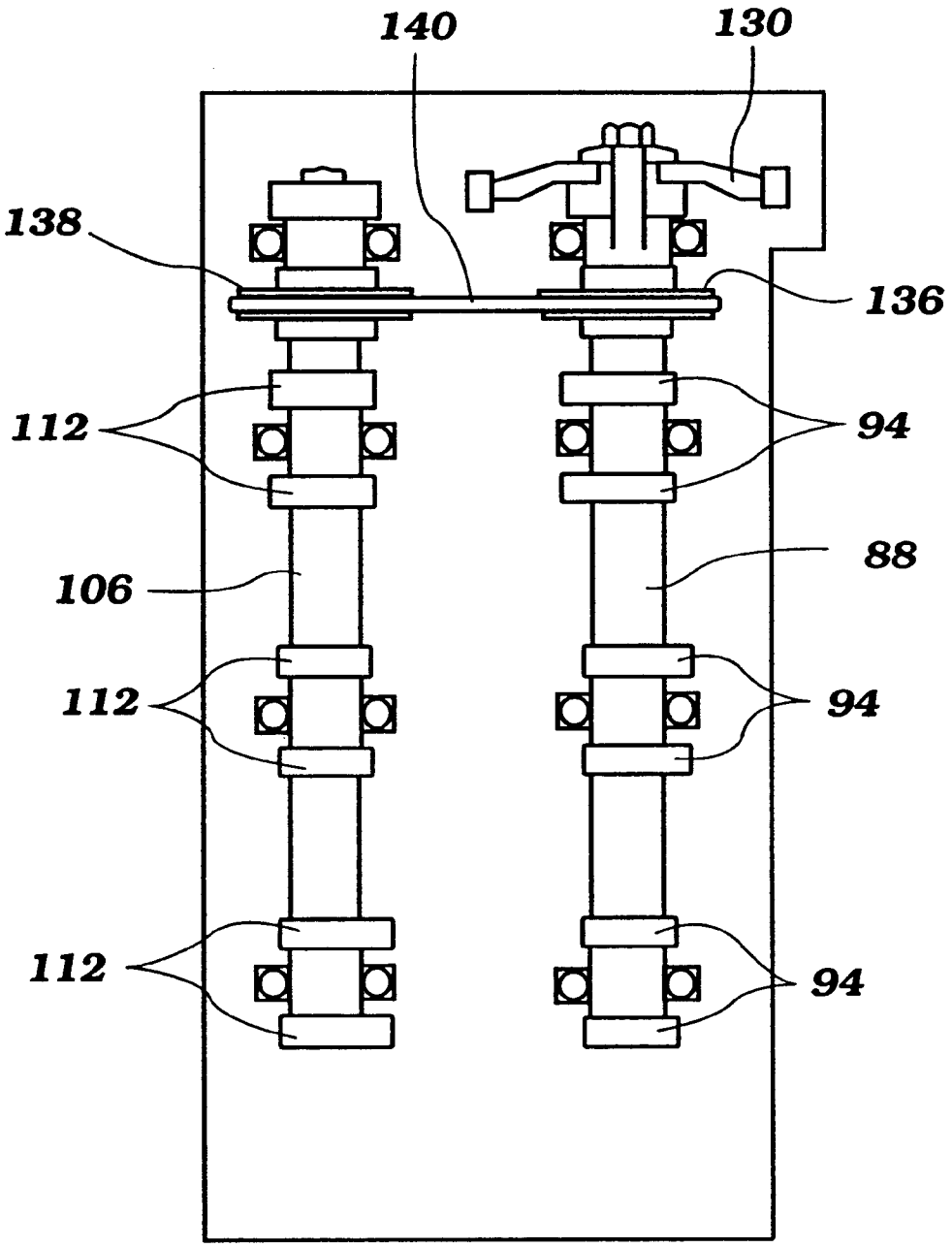
FIG. 6 is a rear elevation view of a portion of the cam drive arrangement associated with a single cylinder bank of the engine.
Figure 7:
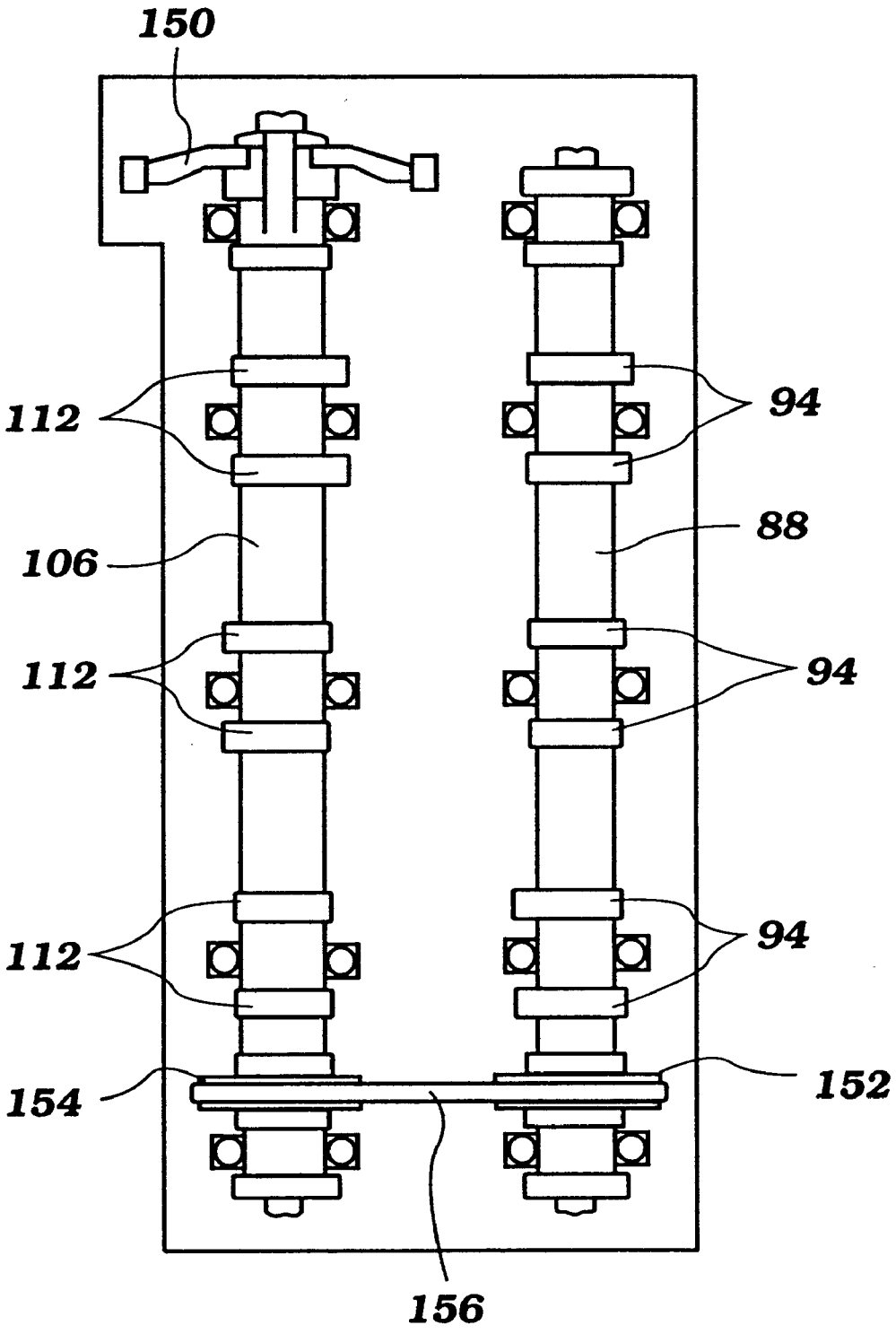
FIG. 7 is another simplified rear elevation view of a cam shaft drive arrangement for the other cylinder bank.

With reference now to FIG. 6, it can be seen that in one cylinder bank, particularly that in which the cylinders lie on a lower location, the drive arrangement between the two cam shafts is positioned at the upper end of the cam shafts 88, 106. With reference now to FIG. 7, it can be seen that in the cylinder bank having the cylinders positioned at a higher location, the interlocking drive arrangement between the cam shafts is preferably disposed at a lower location. In other words, on the cylinder bank having the higher relative positioning for the cylinders, the interlocking drive arrangement is on the bottom of the shafts.

The sprockets 152, 154 preferably are positioned at the bottom end or near the bottom end of the cam shafts 88, 106. This arrangement takes advantage of the relative positionings of the cylinders within the two respective banks. Accordingly, the placement makes use of generally dead space or unused space within the engine compartment thereby allowing the engine to have a smaller relative vertical dimension while maintaining the relatively narrow girth sought after by the offset cylinder arrangement. In addition, this configuration allows the driven pulleys 130, 150 to remain in the same plane while better accommodating the connection between the two shafts (i.e., the sprocket and chain connection). It should be noted that, in some arrangements, the intake cam shafts are directly driven by the crankshaft and, in other arrangements, one intake cam shaft is driven and one exhaust cam shaft is driven.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. An engine for use in an outboard motor comprising a pair of cylinder banks, a first set of cylinder bores disposed in a first cylinder bank of said pair of cylinder banks, a second set of cylinder bores disposed in a second cylinder bank of said pair of cylinder banks, a first plane defined through central axes of said first set of cylinder bores and a second plane defined through central axes of said second set of cylinder bores, said first plane and said second plane intersecting at an angle, said engine having a first end surface, a crankshaft having a power take off end that extends through said first end surface, said first set of cylinder bores having a first end cylinder bore and said second set of cylinder bores having a second end cylinder bore, said first end cylinder bore being positioned closer to said first end surface than said second end cylinder bore, a first intake cam shaft and a first exhaust cam shaft being associated with said first cylinder bank and a second intake cam shaft and a second exhaust cam shaft being associated with said second cylinder bank, power from said crankshaft driving said first intake cam shaft, said first exhaust cam shaft, said second intake cam shaft and said second exhaust cam shaft, said first intake cam shaft and said first exhaust cam shaft being joined by a first drive connection and said second intake cam shaft and said second exhaust cam shaft being joined by a second drive connection, said second drive connection being positioned at an end of said second intake cam shaft and said second exhaust cam shaft that is closest to said first end surface and said first drive connection being positioned at an end of said first intake cam shaft and said first exhaust cam shaft that is farthest from said first end surface.

2. The engine of claim 1 further comprising a drive pulley mounted to said crankshaft and a driven pulley mounted to at least one of said first intake cam shaft and said first exhaust cam shaft.

3. The engine of claim 2, wherein said drive pulley is mounted to an end of said crankshaft that is opposite of said first end surface.

4. The engine of claim 2, wherein said driven pulley is mounted to said exhaust cam shaft.

5. The engine of claim 2 further comprising a drive belt extending around said drive pulley and said driven pulley and an idler pulley maintaining tension on said drive belt.

6. The engine of claim 1, wherein said first drive connection comprises a drive sprocket and a driven sprocket, a chain interconnecting said drive sprocket and said driven sprocket and a slide plate being disposed to apply a normal force to said chain.

7. An engine comprising a crankshaft and a cylinder block that comprises a first cylinder bank and a second cylinder bank, said cylinder block having a first end and an opposing second end, said crankshaft having a power take off end that extends through said first end of said cylinder block, said engine comprising a first set of cam shafts being associated with said first cylinder bank and a second set of cam shafts being associated with said second cylinder bank, said first set of cam shafts being coupled for rotation proximate said first end of said cylinder block and said second set of cam shafts being coupled for rotation proximate said opposing second end of said cylinder block.

8. The engine of claim 7, wherein said first cylinder bank comprises a first set of cylinder bores and said second cylinder bank comprises a second set of cylinder bores, said first set of cylinder bores comprises a first power take off cylinder bore and a first flywheel cylinder bore, said second set of cylinder bores comprising a second power take off cylinder bore and a second flywheel cylinder bore, said first power take off cylinder bore being closer to said first end of said cylinder block than said second power take off cylinder bore.

9. The engine of claim 8, wherein said crankshaft is coupled to at least one of said first set of cam shafts and said second set of cam shafts.

10. The engine of claim 8, wherein said crankshaft is coupled to at least one of said first set of cam shafts and said second set of cam shafts proximate said opposing second end of said cylinder block.

11. The engine of claim 10, wherein said crankshaft is coupled to said first set of cam shafts and to said second set of cam shafts.

12. The engine of claim 11, wherein said first set of cam shafts comprises a first intake cam shaft and a first exhaust cam shaft and said second set of cam shafts comprises a second intake cam shaft and a second exhaust cam shaft, and said crankshaft is coupled to said first exhaust cam shaft and to said second exhaust cam shaft.

13. The engine of claim 11, wherein said crankshaft is coupled to said first set of cam shafts and to said second set of cam shafts with a belt drive assembly.

14. The engine of claim 13, wherein said belt drive assembly comprises an idler pulley.

15. The engine of claim 11, wherein said first set of cam shafts is coupled with a first chain drive assembly and said second set of cam shafts is coupled with a second chain drive assembly.

* * * * *